United States Patent [19]

Mishima

[11] Patent Number: 4,476,751

[45] Date of Patent: Oct. 16, 1984

[54] MULTIPLE SCREWDRIVER

[76] Inventor: Yoshiaki Mishima, 68, 1-chome, Higashiikoma, Ikoma-shi, Nara, Japan

[21] Appl. No.: 527,732

[22] Filed: Aug. 30, 1983

[51] Int. Cl.[3] ..... B25G 1/08

[52] U.S. Cl. ..... 81/440; 145/62

[58] Field of Search ..... 81/440; 145/62

[56] References Cited

U.S. PATENT DOCUMENTS 3,892,149 7/1975 Rydberg ..... 81/440

FOREIGN PATENT DOCUMENTS 464002 8/1928 Fed. Rep. of Germany ..... 81/440

*Primary Examiner*—Frederick R. Schmidt
*Assistant Examiner*—J. T. Zatarga
*Attorney, Agent, or Firm*—Wenderoth, Lind & Ponack

[57] ABSTRACT

A multiple screwdriver having a grip and a plurality of bits coupled to the grip at one end. Each bit has a coupling plate comprising a slant portion and a straight portion parallel to the axis of the bit. The bit is coupled to the grip with its coupling plate in axial slits formed in the head of the grip.

5 Claims, 13 Drawing Figures

MULTIPLE SCREWDRIVER

The present invention relates to a multiple screwdriver having a plurality of types of tools or bits such as a screwdriver and a hexagon socket wrench.

There is known from e.g. Japanese utility model laid-open publication No. 49-55499 a multiple screwdriver which has a grip formed with a plurality of axial grooves angularly spaced in its outer periphery, and bits coupled to the grip at their tip so as to be pivotable by 180 degrees from their inoperative position in these axial grooves to their operative position in alignment with the grip. With such a conventional multiple screwdriver, the bits are coupled to the grip at their one end by means of a pin extending through holes formed in the bits at their one end and supported on the grip at its tip.

The conventional multiple screwdriver had a shortcoming that the hole-formed end of each bit is apt to break due to poor strength. Another shortcoming is that the bit is not sufficiently stably supported in its operative position because it is partly supported in its respective axial groove. A further shortcoming is that the grip has to be formed with holes for supporting the pin and with means for preventing the pin from getting off and thus the screwdriver is time-consuming to produce and assemble.

An object of the present invention is to provide a multiple screwdriver which obviates the above-mentioned shortcomings and which assures a stable support of the bits in their operative position in alignment with the grip.

In accordance with the present invention, the bit can be extremely stably supported in its operative position. Also, the arrangement for support of the bit assures larger mechanical strength and facilitates assembly compared with the conventional multiple screwdriver of this type.

Other objects and features of the present invention will become apparent from the following description taken with reference to the accompanying drawings, in which.

Figure 1:
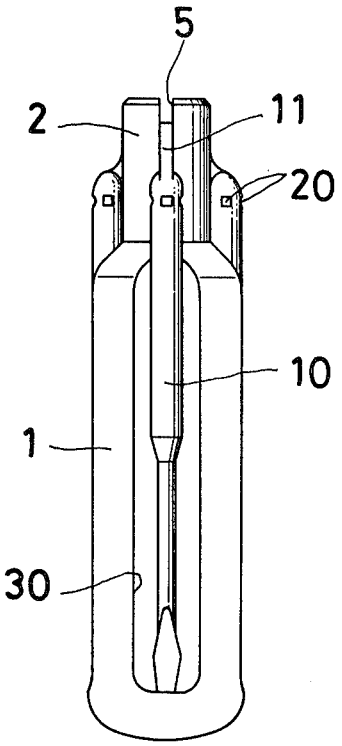
FIG. 1 is a front view of the first embodiment of this invention with the bits in their inoperative position.
Figure 3:
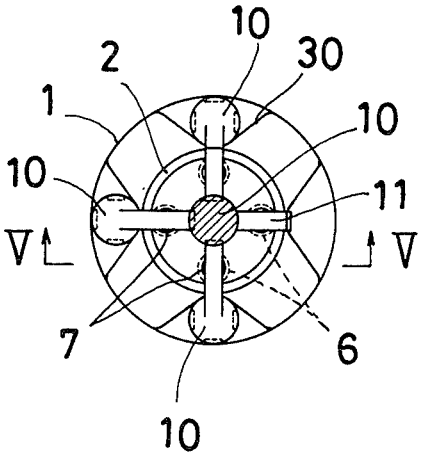
FIG. 3 is an enlarged sectional view taken along the line III—III of FIG. 2.

Referring to the drawings, the multiple screwdriver according to the present invention comprises a grip 1 and a plurality of bits 10.

The grip 1 is molded of synthetic resin with a columnar support 2 in position so as for the support to be integral with the grip. The support is formed at its bottom with a coupling shaft 3 having a plurality of annular grooves 25. Around the coupling shaft 3 there are a plurality of pins 4. Because the coupling shaft and the pins are disposed in the grip, the support 2 is securely coupled to the grip 1.

The support 2 is formed with a plurality of axial slits 5 extending from its tip toward its bottom. The opposing walls of each slit 5 are each formed with an axial guide groove 6 so as to be parallel with the axis of the support 2. The guide grooves are of a semicircular section and continues to smaller guide grooves 7 which are open at the top of the support 2. At the connection between two grooves a shoulder 8 is formed.

The support 2 is formed with a center hole 9 which communicates with the slits 5 and has a circular bottom surface.

Each bit 10 has a coupling plate 11 at its rear end. The coupling plate is of a generally L-shape with a slant portion 12 and a straight portion 13 which is parallel to an extension line of the axis of the bit. The straight portion is formed with a semi-circular projection 14 on its both sides.

The bit 10 is coupled to the support 2 by fitting its coupling plate 11 into its respective slit 5 in the support 2 with its projections 14 in the guide grooves 6 in the slit. With each bit coupled to the support 2, the bit is axially slidable along the guide grooves 6. With the projections 14 on the bit abutting on the shoulder 8, the bit 10 is turnable round the projections 14 by 180 degrees. The shoulder prevents the bit from getting off the slit 6.

In order to couple each bit 10 with the support 2, with the bit disposed in alignment with the axis of the support, the straight portion 13 of the coupling plate 11 in one of the slits 5, and the projections 14 on the straight portion in the smaller guide grooves 7, the bit is driven into the center hole 9.

Figure 7:
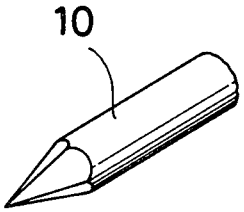
FIGS. 7-9 are perspective views of the tip of various bits.
Figure 8:
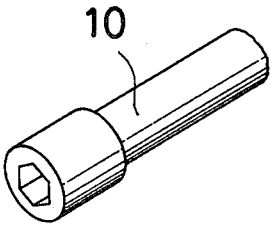
Figure 9:
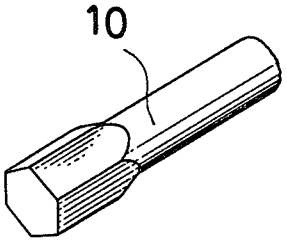

The tip of each bit 10 may be of a ⊖ shape (FIG. 1), of a ⊕ shape (FIG. 2), pointed (FIG. 7), have a box with a hexagonal hole (FIG. 8), or hexagonal (FIG. 9).

Figure 2:
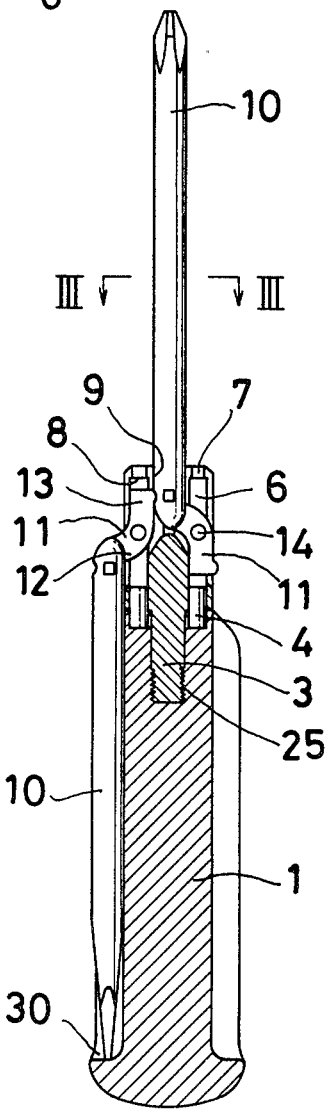
FIG. 2 is a vertical sectional front view thereof when in use.

In use, the bit with a desired shape is selected and brought into operative position in alignment with the grip. Now, suppose that as shown in FIG. 1, all the bits are in their inoperative position in axial grooves 30 formed in the outer periphery of the grip. The selected bit is slid axially upwardly until the projections 14 abut on the shoulder 8, and is turned by 180° around the projections 14. Now the bit will be in alignment with the axis of the grip 1.

Figure 4:
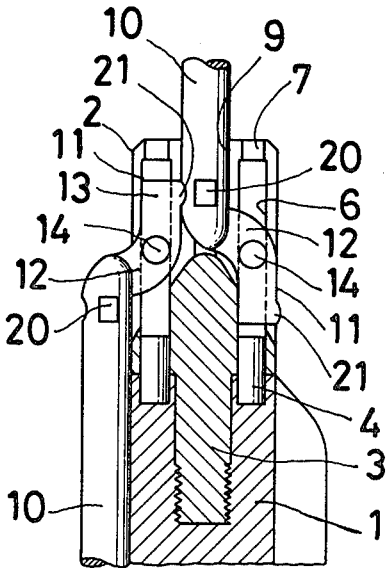
FIG. 4 is an enlarged sectional view of a portion of FIG. 2.
Figure 5:
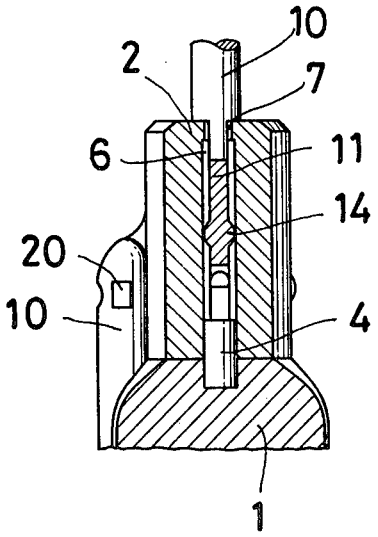
FIG. 5 is a sectional view taken along the line V—V of FIG. 3.

When the bit is pushed into the center hole 9, it will be stably supported in its upright position (FIGS. 2 and 4) because the straight portion 13 of its coupling plate 11 tightly fits in the lower portion of the slit 5. With one bit 10 pushed into the center hole, the straight portions 13 of the other bits 10 abut against the lower portion of the one bit so that the other bits will be prevented from pivotting upwardly into their operative position.

In order to get the bit 10 into its inoperative position, it is pulled upwardly until the projections 14 abut the shoulder 8. Now it can be pivoted by 180° degrees into the axial groove 30 in the grip 1. In this folded state, the multiple screwdriver of this invention is compact for easy carrying.

Each bit 10 may be formed with a pair of projections 20 at its part where it connects with the coupling plate 11 and formed with a projection 21 on the coupling plate at its inner side. (FIG. 4) When one bit 10 is pushed into the center hole 9, its projections 20 may be adapted to engage the projection 21 on the other bits in their inoperative position. This assures a stable, firm support of the bit on the grip.

Since the bits 10 fit snugly in the grooves 30 in the outer periphery of the grip 1, the multiple screwdriver of this invention is easy to grip to tighten a bolt or the like. The grip may have a smaller diameter than the support 2.

Figure 6:
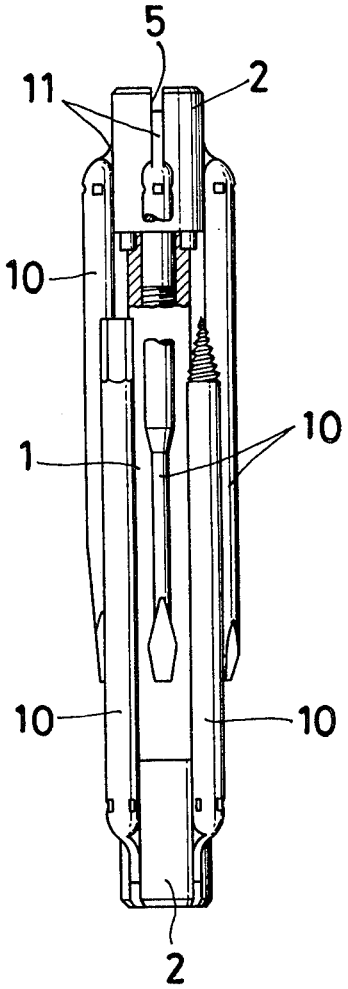
FIG. 6 is a partially cutaway front view of another embodiment.

The number of the bits 10 is optional. As shown in FIG. 6, the grip 1 may be provided with the support 2 not at one end thereof but at both ends, and another set of bits 10 may be adapted to be mounted on the support at the other end, too.

Figure 10:
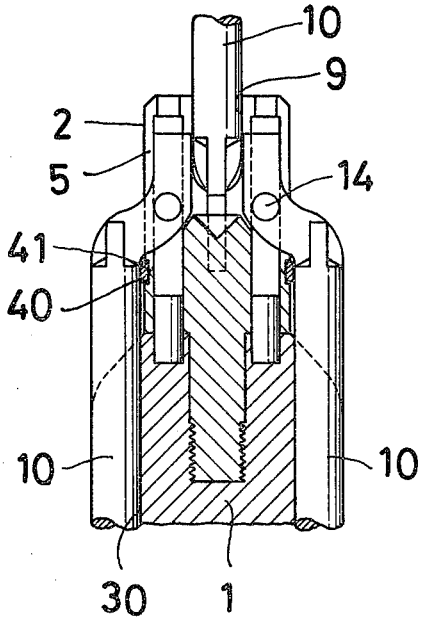
FIGS. 10 and 11 are enlarged sectional views of the third embodiment.
Figure 11:
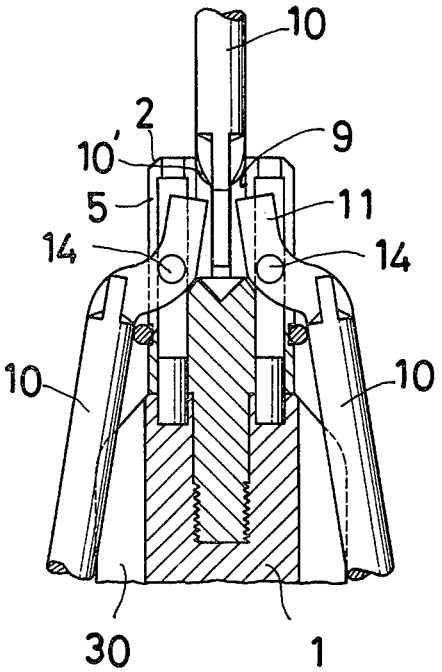

Referring to FIGS. 10 and 11 showing the third embodiment, the support 2 is formed with an annular groove 40 to receive a ring 41 made of an elastic material such as rubber. The ring is disposed adjacent to the lower end of the axial slits 5. When the bits 10 are pivoted toward their respective axial grooves 30, the inner side of their lower end abuts the ring 41 so that the ring will prevent the bits 10 from fitting into the axial grooves 30. (FIG. 11)

When one bit 10 to be used is pivoted by 180 degrees into alignment with the grip 1 (FIG. 11) and pushed into the center hole 9 (FIG. 10), its rounded lower end 10' will engage the inner side of the coupling plates 11 of the other bits 10 which slightly project into the center hole 9, thus urging the bits 10 outwardly. This causes the bits to pivot around their projections 14 and fit into their axial grooves 30. The bits then deform the ring 41 flat and the elasticity of the ring acts on the bits 10 in such a direction to urge them out of the axial grooves. By reaction, the inner sides of the coupling plates 11 on the bits 10 inwardly urge the bit in its operative position at its rounded end 10'. This prevents the bit in use from getting off the center hole 9.

Figure 12:
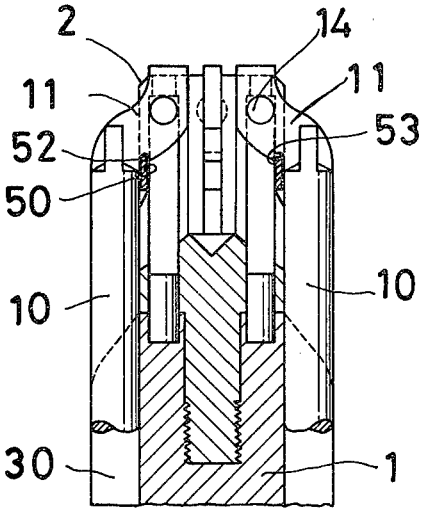
FIGS. 12 and 13 are enlarged sectional views of the fourth embodiment.
Figure 13:
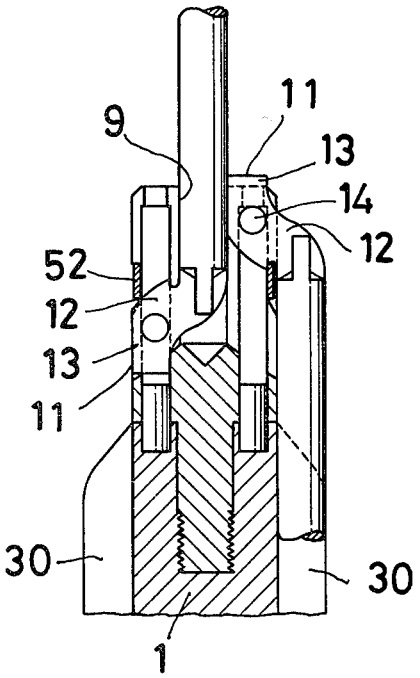

Referring to FIGS. 12 and 13, the support 2 is formed with an annular groove 50 tapered at its lower end to receive a slitted ring 52. With the bits 10 fitted in their axial grooves 30, the slitted ring partially fits in notches 53 formed in the coupling plates 11 on the bits 10 at their inner edge, thus preventing the bits 10 from getting off the axial grooves 30.

With the bits 10 in the axial grooves 30 (FIG. 12), when one of the bits 10 is pivoted about its projection 14, the slitted ring 52 will get out of the notch 53. It is once spreaded and then shrinks into its original state. When the bit is further pivoted until it is aligned with the grip 1, the outer edge of the straight portion 13 on the bit 10 abuts the inner periphery of the slitted ring 52 and spreads it again. When the bit is pushed into the center hole 9, the straight portion 13 will clear the slitted ring 52 but the outer edge of the slant portion 12 engages the lower edge of the slitted ring to prevent the bit 10 from getting off the center hole 9. This assures a secure support of the bit in their operative position.

What are claimed are:

1. A multiple screwdriver comprises a grip having a support at one end thereof, a plurality of bits coupled at one end thereof to said support, said support being formed with as many axial slits as said bits so as to extend downwardly from its top and with a center hole communicating with said slits to receive said each bit, said each slit having on its opposing walls a pair of axial guide grooves which have a shoulder adjacent to its upper end, each of said bits being formed at its coupled end with a coupling plate having a slant portion and a straight portion parallel with the axis of said bit, said coupling plate being formed on each side thereof with a projection, said coupling plate of said each bit being adapted to fit in said slit with said projections in said guide grooves, whereby said each bit is axially slidable along said axial guide grooves and pivotable around said projections between its inoperative position where said bit is folded on the side of said grip and its operative position where said bit is aligned with said grip and pushed into said center hole.

2. The multiple screwdriver as claimed in claim 1 wherein said grip is formed with axial grooves to receive said bits therein.

3. The multiple screwdriver as claimed in claim 1 wherein said each bit is formed with a pair of projections at position where it connects with said coupling plate and with another projection on said coupling plate at inner side thereof.

4. The multiple screwdriver as claimed in claim 1 wherein said support is formed with an annular groove to receive a ring of an elastic material.

5. The multiple screwdriver as claimed in claim 1 wherein said support is formed with an annular groove to receive a slitted ring, said slitted ring being adapted to partially fit in notches formed in said coupling plates on said bits.

* * * * *